United States Patent [19]

Roberts

[11] Patent Number: 4,468,959

[45] Date of Patent: Sep. 4, 1984

[54] METHOD AND APPARATUS FOR TALLYING PIPE

[76] Inventor: Royce G. Roberts, P.O. Box 1296, Kenai, Ak. 99611

[21] Appl. No.: 376,860

[22] Filed: May 10, 1982

[51] Int. Cl.[3] ..... G01B 21/02

[52] U.S. Cl. ..... 73/151; 367/99; 73/432 R

[58] Field of Search ..... 73/432 G, 151, 432 R; 364/562; 367/99, 107, 108, 115, 118, 124, 126, 128, 129; 356/383; 175/41, 40; 250/358.1

[56] References Cited

U.S. PATENT DOCUMENTS

| | | | |
|---|---|---|---|
| 2,096,995 | 10/1937 | Mizell | 73/151 X |
| 2,166,212 | 7/1939 | Hayward | 73/151 X |
| 2,629,257 | 2/1953 | Link | 73/151 |
| 3,890,840 | 6/1975 | Malloy | 367/115 X |
| 4,136,394 | 1/1979 | Jones et al. | 364/561 |
| 4,170,765 | 10/1979 | Austin et al. | 367/108 X |
| 4,180,814 | 12/1979 | Barton | 367/126 X |
| 4,241,430 | 12/1980 | Kayem et al. | 73/597 X |

*Primary Examiner*—S. Clement Swisher
*Assistant Examiner*—Tom Noland
*Attorney, Agent, or Firm*—Marcus L. Bates

[57] ABSTRACT

Tubular goods, such as drill pipe and production tubing, are measured while going into and coming out of a borehole. An electronic beam is directed from a transmitter and is detected by a distance measuring receiver. The beam commences at a known station relative to one end of a pipe suspended in the derrick; and is received at a second station which is indexed respective to the traveling block of the drilling rig. Another beam measures the position of the other end of the pipe respective to the traveling block. These measurements enable the length of each stand of pipe to be accurately ascertained while the pipe is held suspended within the derrick at a location above the derrick floor. Electronic circuitry, including a digital instrument, automatically computes the length, displays the length in feet and tenths on a digital readout, records the length on a print-out tape, and incorporates an accumulative memory register. This enables joints or lengths of pipe to be tallied, one after another, and the lengths are automatically calculated while accumulative totals are displayed and recorded.

23 Claims, 5 Drawing Figures

METHOD AND APPARATUS FOR TALLYING PIPE

BACKGROUND OF THE INVENTION

The drilling and production of oil wells require the use of various different tubular goods, such as drill pipe, casing, and tubing. The joints are provided with both a box end and a pin end, that is, a female and a male threaded surface located at the opposed marginal ends of the joint. The two threaded members constitute a threaded fastener and are designed to engage one another with friction, thereby precluding one member inadvertently being unscrewed from the other. A series of connected threaded joints are made up to form a string.

From time to time these threaded surfaces become unduly worn and must occasionally be renewed by reforming the threads at the box and pin ends. This always shortens the joint a trifle, each time the threads are renewed. Therefore, since specific lengths of a drill string are often required for specific oil well applications, it is necessary that accurate joint length calculations and recordings be made and retained.

At various stages of the drilling operations, tubular goods must be brought up from the well and elevated vertically above the drilling rig floor. This normally is accomplished with the use of a traveling block which is raised or lowered above the rig floor by means of a crown block assembly located at the top of the derrick, which is powered by a draw works or series of winches located on the rig floor, and a heavy duty wire cable system. An elevator or set of elevators is suspended beneath the traveling block by means of a drilling hook or set of bales. The traveling block assembly is lowered into proximity of the rig floor where the elevators are manually attached around the box end of the string to be raised or elevated from the hole. Normally the string is elevated in sections of three threadedly connected joints at one time called a stand of pipe. When three joints or a stand has been elevated above the rig floor, slips are inserted between the pipe and the inner surface of the rotary table up-holding the remaining portion of the string below the rig floor while the disconnection or connection is made. Each three-joint section must be measured for length as an accurate accounting of the lengths of these tubular goods is required as they are elevated from and returned to the drilling operations below the drilling rig floor.

The present art of ascertaining the length of each three-joint section consists of a steel measuring tape held from the box end to the pin end of the joint section to be measured, with the measurements being manually taken and recorded and totaled on a tally sheet. The accuracy and efficiency of this time consuming method is entirely dependent on the accuracy and efficiency of the individuals tallying and recording, which periodically allows room for inaccuracy, error, and inefficiency. Accordingly, it would be desirable to have a means by which each joint length can be measured, automatically computed, displayed, recorded, and totals displayed and recorded at will without the element of human error and inaccuracy. Such a desirable instrument is the subject of this invention.

The prior art teaches all sorts of means by which distance between two stations can be accurately measured electronically, as evidenced by the U.S. Pat. Nos. 4,136,394; 4,162,473; 4,241,430; and No. 4,281,404; respectively, issued to Jones; Utasi; Kayem, et al; and Morrow, et al; respectively, to which reference is made for the electronic details set forth therein. Reference is also made to the art cited in these four patents, and to other similar patents to be found in Class 73, 340, 364, 367, and other appropriate art areas of the U.S. Patent Office.

Jones teaches measuring between two points by the employment of a remote unit which transmits a radio pulse to a base unit. The base unit returns an acoustic or sonic signal in response to the received radio pulse. Internal logic at the remote unit determines the distance involved by using the time intervals of the signals.

Utasi teaches a transducer which generates sound waves which are directed towards a surface, and reflected to a detector, where the signal is treated to provide a measurement of the distances involved. There are numerous patents in Class 73 which illustrate various sonic and ultrasonic generators and detectors for achieving this same purpose.

Kayem, et al. determines the length of a tubular member from one end thereof by the employment of a device which produces sound pulses, and a detector which receives the pulse signal. Circuitry computes the distances involved.

Morrow, et al. discloses a sonic transducer which transmits and receives sonic impulses which are treated by circuitry in order to measure distances through water.

While others have devised various different means by which relatively short distances may be accurately measured, no one has heretofore suggested means for electronically measuring lengths of pipe supported within a derrick of a drilling rig.

SUMMARY OF THE INVENTION

This invention comprehends a method which uses a digital instrument for automatically measuring, displaying, and recording the lengths of tubular goods, such as drill pipe, casing, and tubing, vertically suspended above the drilling rig floor of a drilling rig. The measurement required is from the box end to the pin end of one or a plurality of connected threaded joints.

The instrument includes a transmitter positioned at or near one end of the joints to be measured or tallied, and when activated, automatically transmits a distance measuring beam, computes the length of the pipe stand, displays the length in feet or meters on a digital readout, records the length on a print-out tape, and incorporates a cumulative memory register. Another component of the apparatus is positioned at or near the opposite end of the joints to be measured or tallied and deflects the transmitted distance measuring beam back to a receiver to enable a length computation to be effected electronically.

The transmitter, in one form of the invention, incorporates standard electronic digital printing calculator techniques including addition, subtraction, division, and multiplication functions as well as a memory register.

In one embodiment of the invention, the first component or transmitting portion of the apparatus utilizes a standard desk calculator configuration and is either wall or desk mounted at or near the drilling rig floor and the rotary table where the pin end of the joints to be tallied are momentarily positioned. This component is powered by any suitable means, such as standard 110 Voltage AC or battery powered for isloated use, for example. The distance measuring beam is transmitted from the transmitter and received by another component located at a precise location respective to the pin end of the joints to be tallied. This last component is mounted on an adjustable swinging arm having means by which it can be removed from the working area of the drilling rig floor when measurement computations of each successive elevated section of joints are completed. The two components may be interconnected electrically by means of radio signals or by wires.

In another embodiment of the invention, the transmitting and receiving components are mounted together on the pivotal end of a swinging arm at the precise location adjacent the pin end of the joints to be measured.

In another embodiment of the invention, the transmitting components are integrated into a single unit and mounted on a swinging arm at a precise point respective to the pin end of the joints to be measured.

In still another embodiment of the invention, the transmitting components are integrated into a single unit and are housed within a lightweight, rugged, hand-held, gun-type configuration and operatively positioned at the precise location on the pin end of the stand or joints to be measured.

In still another embodiment of the invention, the transmitting antenna portion of the transmitting component utilizes a lightweight, hand-held, gun-type apparatus which is operatively applied at the precise position on the pin end of the joints to be measured, and the computation and recording apparatus is housed in a separate component utilizing a standard digital printing calculator configuration, and may be wall, desk, or otherwise mounted at a remote location.

The apparatus includes a deflector or reflector which, being positioned at or near the opposite, or box end, of the joints to be measured, deflects or reflects the transmitted distance measuring beam back to the first component for length computation.

In another embodiment of the invention, the second component or deflecting portion is firmly attached to a lower portion of one of the bales associated with the traveling block and near the marginal end of the box end of the joints to be measured.

In another embodiment of the invention, the second component incorporates a prism-like device which deflects the transmitted distance measuring beam horizontally across the marginal end of the box end of the joints to be measured. In this embodiment, a deflector or series of deflectors is firmly affixed at pre-determined settings to the lower portion of the opposing bale.

In another embodiment of the invention, the second component includes means by which it is firmly attached to the traveling block; and, also includes means for deducting from the total distance measurement beam the distance from the box end of the joints to be measured.

In another embodiment of the invention, the second component includes means for being firmly attached to the elevators, and also includes means for adding to the distance measurement beam, the distance to the box end of the joints to be measured.

In yet another embodiment of the invention, the second component includes means for being attached to the derrick structure and further includes means for receiving and deflecting the horizontal distance measurement beam at a wide range of elevations. In this embodiment the vertical distance measurement beam is refracted horizontally to and from the second component by means of a prism-like device firmly attached to the lower portion of one of the bales at one of the various predetermined settings according to the location of the marginal end of the box end of the joints to be measured.

Accordingly, a primary object of the present invention is the provision of an instrument for measuring and recording joint section lengths of tubular goods vertically suspended above the drilling floor of an oil well drilling rig.

Another object of the present invention is the provision of a method by which stands of pipe held suspended within a derrick can be tallied, one after another, and lengths thereof calculated so that accumulative totals are available.

Still another object of this invention is to provide method and apparatus by which successive stands of pipe used downhole in a borehole are tallied as the pipe goes into and comes out of the borehole.

A still further object of this invention is the provision of method and apparatus by which the length of a stand of pipe is electronically measured while the pipe is held suspended within an oil well drilling derrick.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENTS

Figure 1:
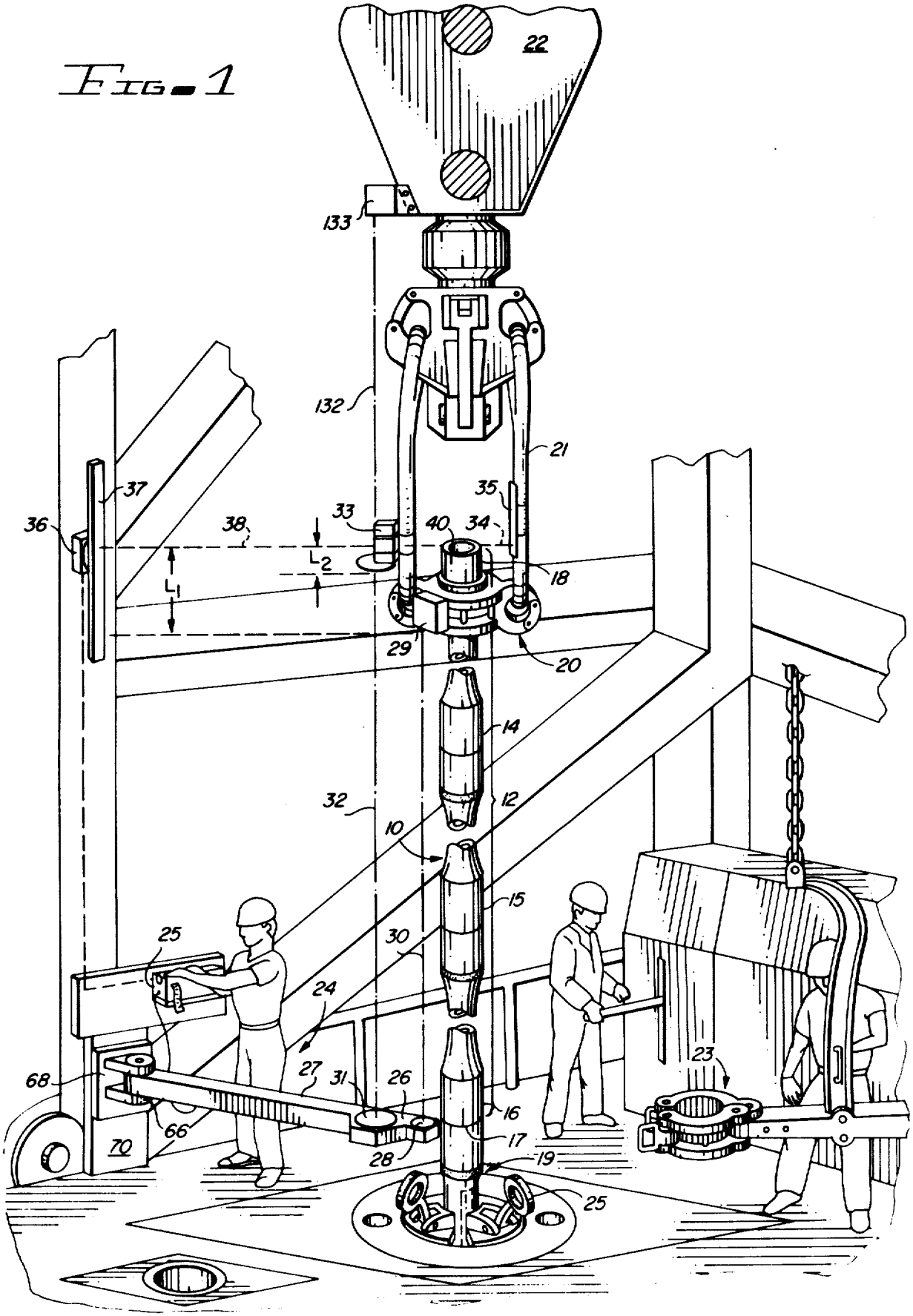
FIG. 1 is a fragmentary, broken view of an oil well drilling rig having various different embodiments of apparatus made in accordance with the present invention associated therewith.

In FIG. 1, together with other figures of the drawings, there is disclosed a stand of pipe 10 having a total length 12 equivalent to the sum of the effective length of the illustrated pipe joints 14, 15, and 16. The pipe joints which make up the stand of pipe are threadedly fastened together in a manner known to those skilled in the art. The pipe continues downhole from the shoulder 17 near the end of the stand. The end of joint 16 terminates in a male threaded fastener which extends into the upwardly opening box or female connector of the remainder of the drill string. The upper end 18 of the stand is in the form of a box, or threaded female cavity, and terminates in a shoulder or circumferentially extending edge.

Elevators 20 are suspended from drilling hooks or bales 21 which in turn are suspended from a traveling block 22. The traveling block comprises part of the draw works (not shown) of the drilling rig which lifts the entire weight of the drill string. The traveling block, bales, and elevators are referred to in the appended claims as the "traveling block assembly".

The arrow at numeral 24 broadly indicates part of the apparatus, made in accordance with the present invention, for ascertaining the length 12 of pipe stand 10. The apparatus includes a calculator and printer apparatus 25. The marginal terminal end 26 of cantilever arm 27 is indexed with shoulders 17 formed at the interface at the lower end of the stand. The free marginal end of the arm supports a transmitting and receiving antenna apparatus 28 which is aligned with deflector apparatus 29 located on the elevators 20. The deflector receives a beam 30 and reflects the beam back along the same path where the beam is received by the antenna 28. Alternatively, the beam can be projected along a second path to be received slightly spaced from antenna 28.

The antenna 28 is indexed respective to shoulder 17 and to the derrick floor. The apparatus 25, 28, and 29 jointly cooperate together to measure the distance between the antenna and the deflector. Therefore, the length of the stand is known except for the variable distance L1 measured between the face of the deflector 29 and the terminal end of box 18, which will be subsequently determined in accordance with the present invention, in a manner which will be explained later on in this disclosure.

Apparatus 25 together with apparatus 31 provides a suitable electronic beam which is transmitted from antenna 31, with the beam being directed along path 32 where it impinges on deflector device 33 and is directed more or less horizontally at 34 onto deflector 35. The beam is returned from 35 along path 34 to deflector 33, back along path 32 where the beam is received by the antenna 31, thereby enabling the distance L1 to be computed by the circuitry.

As an alternate embodiment of the invention, the reflector 33 and transmitter antenna and receiver 31 are utilized for ascertaining the first measurement of the length of the stand of pipe in lieu of the device 28 and 29. This necessitates the employment of a transmitter and receiver 36 having an elongated antenna 37 for directing wide angle beam 38 across the upper terminal end 40 of the box end 18 of the stand of pipe. The portion of the beam not shielded by the pipe is reflected back along path 38 and is received by antenna 37, where the signal is conducted to the calculator 25, so that the length L2 can be added to the previous measurement found in conjunction with beam 32.

As another alternate embodiment of the present invention, the antenna 31 directs a beam at 132 up to a deflector 133 located in fixed relationship respective to the crown block 22, thereby providing accurate measurement of the distance between the deflector face at 133 and the shoulder 17. The measurement at 38 must now be subtracted from the measurement at 132 in order to ascertain the length 12 of the stand.

Figure 2:
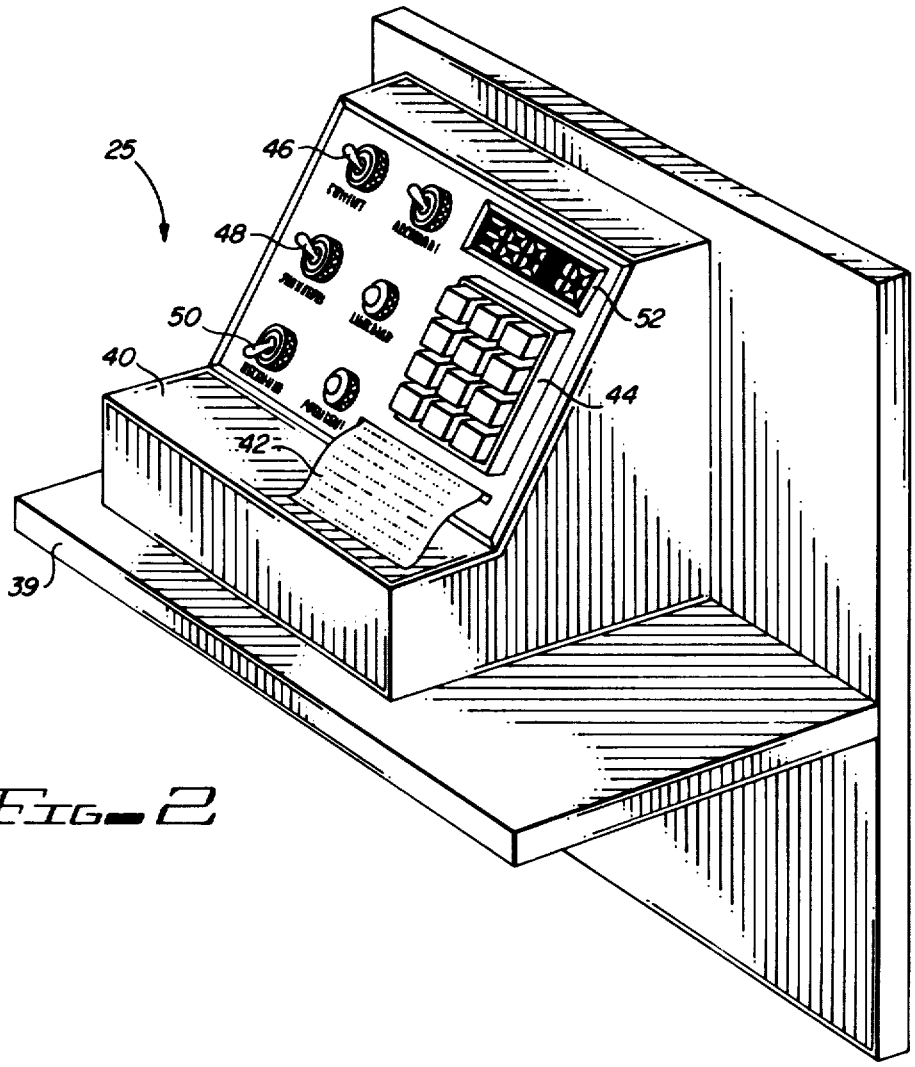
FIG. 2 is an enlarged, perspective view of part of the apparatus disclosed in FIG. 1.

As seen in FIG. 2, the calculator 25 can be mounted on any suitable support surface 39. The calculator is placed within a rugged console 40 which protects the electrical components from damage. Numeral 42 indicates print out data in the form of printed numerals permanently placed on a piece of paper which provides data related to the foregoing measurements. Calculator 44 can also be used for programming the apparatus 25 as may be desired. Numerals 46, 48, and 50 indicate various switches which may advantageously be employed in order to retrieve different available data at window 52.

Figure 3:
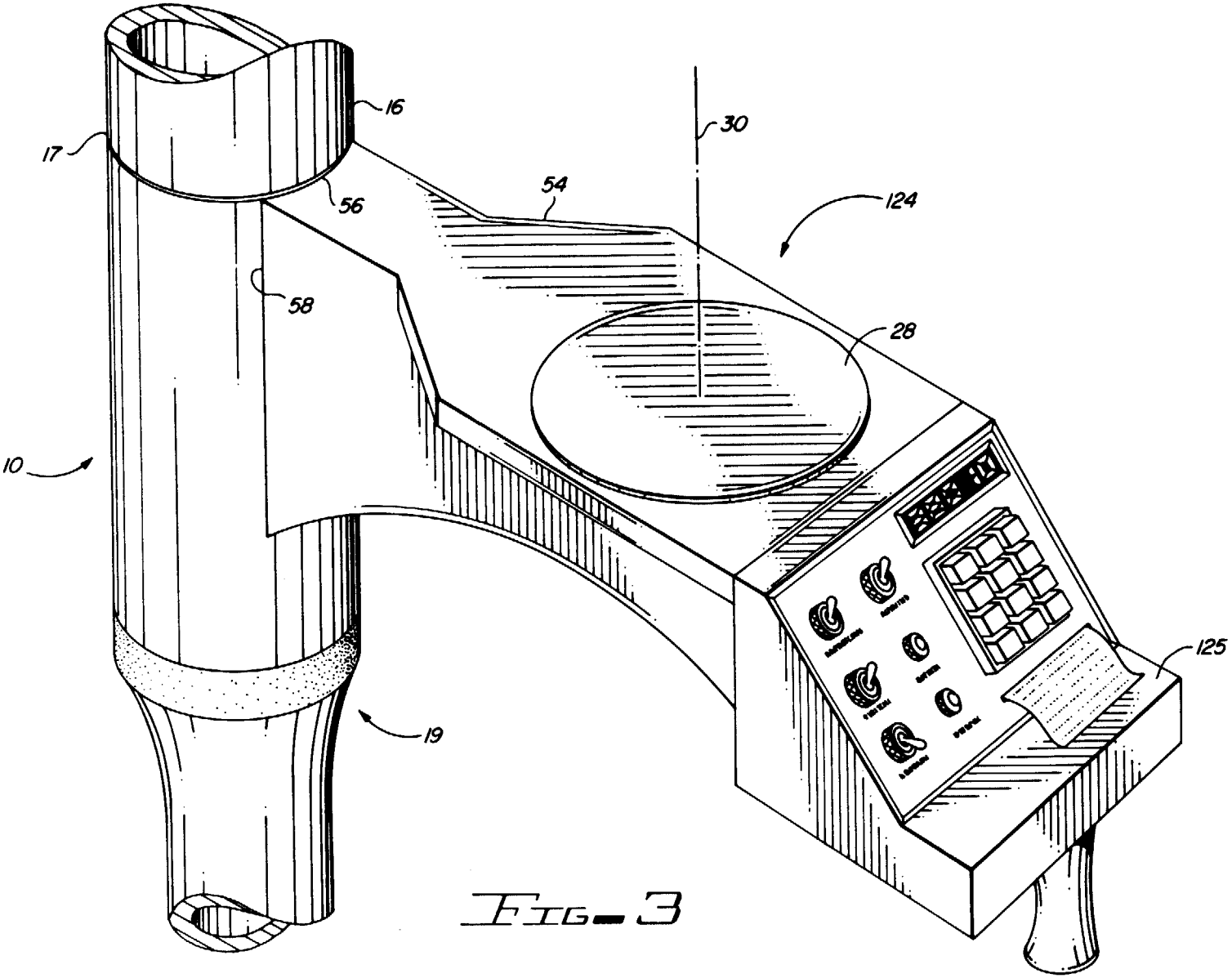
FIG. 3 is an enlarged, fragmentary, perspective view of an alternate embodiment of the apparatus disclosed in FIG. 2.

In FIG. 3, there is disclosed a modification 124 of the apparatus disclosed in the foregoing figures. In this portable embodiment of the invention, there is included a calculator 125, similar in many respects to the calculator 25. Antenna 28 is mounted between the stand of pipe 10 and the calculator by means of the illustrated cantilever support arm 54. The arm terminates forwardly at edge portion 56, forms an alignment member which is curved and brought into alignment with shoulder 17 of the illustrated coacting joints of the pipe stand and pipe string. The arm continues downwardly at 58 and the outer face thereof is curved complimentary respective to the tool joints or subs which form the interface 17 at the connected together box and pin ends of the coacting pipe lengths.

Figure 4:
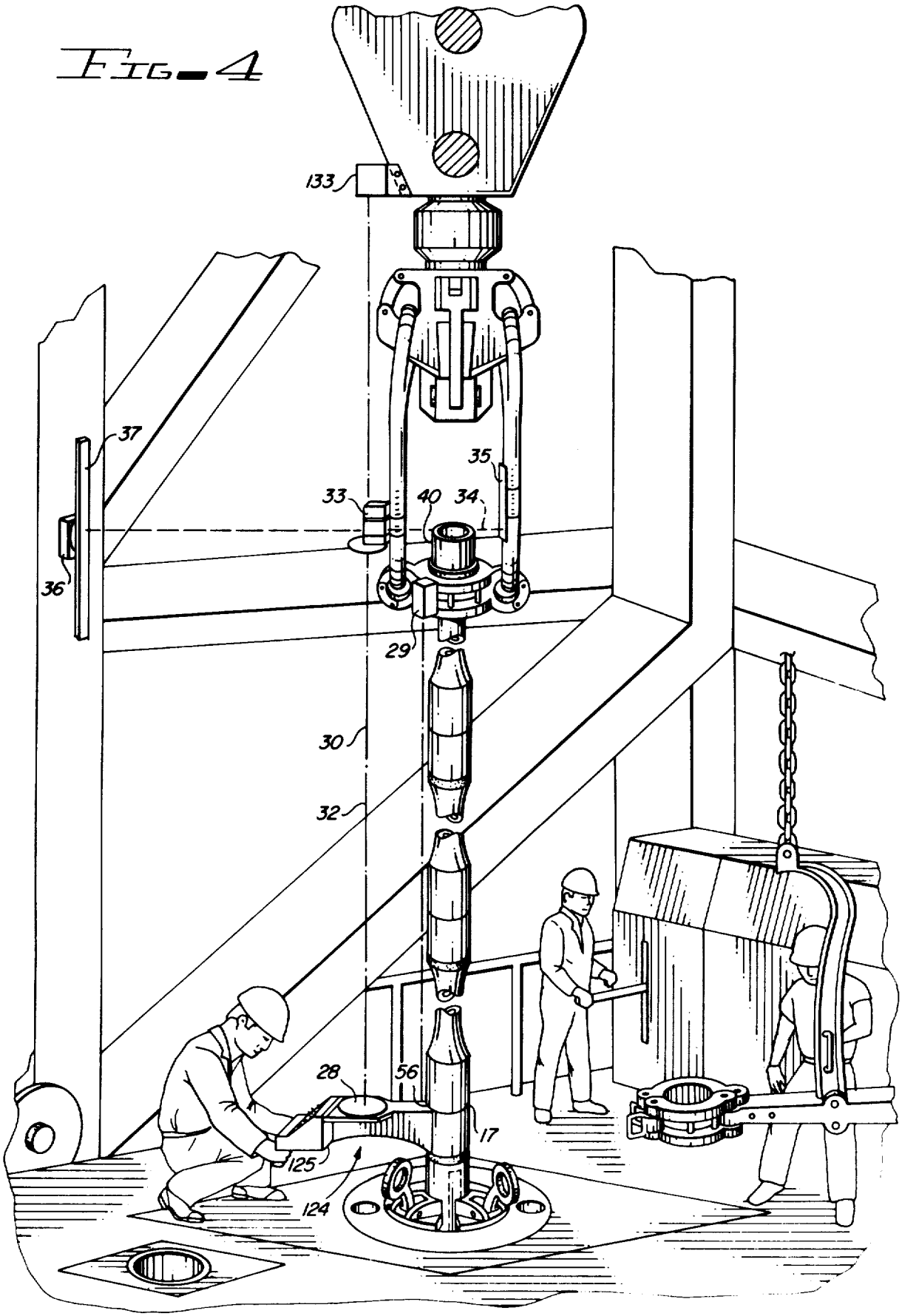
FIG. 4 is a fragmentary, broken, perspective view of an oil well drilling rig with the present invention being included therewith.

In FIG. 4, the apparatus 124 is shown in operative relationship respective to the drilling rig and to the remainder of the present novel apparatus. As seen in FIG. 4, the beam 30 is deflected by reflector device 33, or alternatively, deflector device 133. The beam is returned along essentially the same path 32 back to the antenna 28.

Transmitter 36 is connected to a vertical antenna 37 which is aligned with the vertical deflector 35 so that a wide beam 34 travels from antenna 37 to antenna 35 and is deflected back to an antenna at 37, thereby providing data respective to the location of the top or box end of the stand of pipe.

In FIG. 4, the top edge 56 of the self contained calculator 125 is arranged such that the antenna 28 is indexed with shoulder 17, thereby defining the location of the shoulder at the lower end of the stand of pipe. The distance measuring apparatus of the calculator 125 establishes the distance between deflector 33 and the shoulder 17.

The antenna 37 and deflector 35 establishes the length measured between the upper shoulder 40 of the box end of the pipe stand and the deflector at 33. From these measurements, precise calculations to determine the length of the stand of pipe can be made by the apparatus 124.

Figure 5:
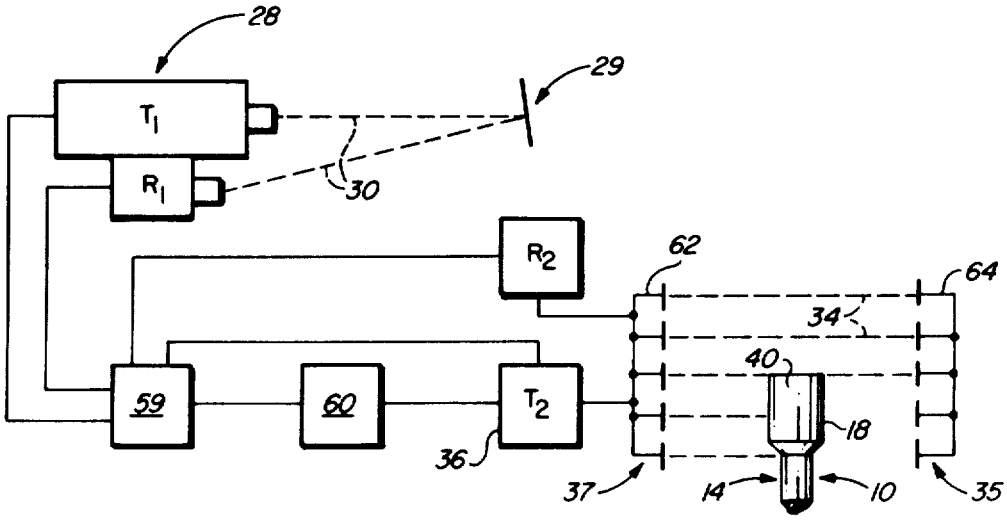
FIG. 5 is a part schematical, part diagrammatical representation of circuitry associated with the present invention.

In FIG. 5, the apparatus 28 comprises a transmitter T1 which sends a signal 30 to the deflector 29. The deflector returns the signal to the distance measuring receiver R1. Distance measuring apparatus for achieving this function of the disclosure is known to those skilled in the art, for example surveying instruments using the laser principle and the like. Data related to the distance measured is stored by the calculator at 59.

At the same time, transmitter T2 provides various different signals to the antenna array 37, which in one form of the invention is comprised of a plurality of individual antennas 62 aligned with a plurality of reflectors 35 which return the signal to receiver R2, thereby providing a signal indicative of the height of shoulder 40 of the upper box end 18 respective to the face of the antenna which deflected the signal 30.

The return signal is received at R2 and is connected to the calculator at 59. The two signals 30 and 34 are integrated to provide the length 12 between shoulders 17 and 40.

In operation, while going into the borehole with a stand of drilling pipe, the slips are arranged to hold the upper marginal end of the drill string, while the stand of pipe is hoisted by elevator 20 into the derrick so that the tongs can make up the stand of pipe into the drill string. As this is being accomplished, the antenna 28 is indexed with the shoulder 17 by one of the above manipulations.

The driller or operator energizes the calculator apparatus thereby ascertaining the distance between shoulder 17 and deflector 29. At the same time, the length L1 is determined in the above described manner. The calculator integrates the two signals and the resultant measurement is printed at 42, thereby providing the length of each individual stand of pipe, as well as the cumulative total of the successively connected together stands of pipe. This data also appears at window 22 depending on which of the switches 46–50 are actuated.

After all of the tubing has been run into the hole, the cumulative total is available at 42 and 52. The present apparatus provides a rapid, efficient, and reliable means for ascertaining the length of tubular goods which have been sent downhole or which have been returned from the hole. The present disclosure includes measuring the stands of pipe as well as measuring the individual joints of pipe as they are added to the drilling operation.

In this disclosure, the term "beam" is intended to include a signal which propagates the atmosphere, and includes lasers, radio beams, and ultrasonics.

The term "transmitter" includes an electrical means or electro-mechanical means for producing the beam.

The term "receiver" is an electrical means or electro-mechanical means for detecting or receiving the beam.

The term "antenna" is intended to include apparatus for sending and receiving the beam.

The term "transducer" includes a transmitter which transmits a beam and a receiver which receives the returned beam.

The length of the box end, or last measurement, usually varies from 7–12 inches; and, the box end is always pointed up. The distance measured between the interface where the two joints are connected together and the lower end of the pin is of no consequence because the telescoping or threaded end is received within a box and therefore is not part of the calculation. It is therefore necessary to measure from shoulder to shoulder of a pipe joint or a stand of pipe joints in order for the length to be calculated. Since the distance from the elevator to the upper terminal end or shoulder of the upper most joint varies from pipe joint to pipe joint, the first measurement by the first transmitted signal provides an approximation which may be as much as 5 inches in error, as noted above. Therefore, the second signal must accurately provide this second measurement which is added to the first measurement, thereby accurately determining the length of the pipe member.

The present technique generally is far more accurate than manually measuring the pipe, especially when the measurement is made under adverse conditions such as during sand storms, spraying mud, rain, and the like.

I claim:

1. In a drilling rig having a traveling block assembly to which there is connected a pipe elevator by which a pipe stand can be elevated above the derrick floor thereof; the pipe stand being made of series connected pipe lengths each having a shoulder formed at each opposed end thereof, the combination with said drilling rig of apparatus for tallying the length of the pipe stand while it is suspended above the derrick floor;

said apparatus includes a transmitter and receiver means having an antenna, means by which said antenna is positioned in indexed relationship respective to a pipe shoulder which defines the lower end of a pipe stand;

a deflector means mounted on said traveling block assembly for deflecting a beam from said transmitter back to said receiver antenna to thereby provide a first signal related to the distance from the antenna to the deflector;

another transmitter and receiver means connected to another antenna; said another antenna being positioned in indexed relationship respective to said deflector; a second deflector, said another antenna and said second deflector are positioned to direct another beam substantially horizontally across the upper terminal end of the stand of pipe; to provide a second signal related to the distance measured from the upper end of the stand of pipe to the first recited deflector;

means for adding the first and second signals together to provide the measured length of the stand of pipe.

2. The combination of claim 1 wherein said means for adding is electronic circuitry which includes a digital instrument; said digital instrument automatically computes the length of the pipe stand, displays the length of said pipe stand on a digital read-out, and records the length thereof.

3. The combination of claim 2 wherein said instrument includes an accumulative memory register which sequentially adds the measured length of each stand of pipe together to provide a pipe tally.

4. The combination of claim 3 wherein the first recited transmitter, receiver, and antenna are provided on a hand held probe; said probe has an arm extending therefrom which terminates to form a contoured end made complimentarily respective to the lower marginal end of the stand of pipe; said arm further includes an alignment member which can be brought into aligned relationship with respect to the shoulder at the lower end of the stand of pipe, and the first recited antenna is indexed with respect to said alignment member.

5. The combination of claim 3 wherein the first recited transmitter and receiver means, and the antenna therefor are mounted on an arm, said arm has one end pivotally attached to a support structure, said arm includes another end which supports the first recited antenna; index means which can be brought into alignment with the lower end of the stand of pipe to thereby index the said first recited antenna with the lower end of the stand of pipe.

6. Method of measuring a stand of pipe while a traveling block assembly supports the stand above a rig floor while going into and coming out of a borehole; comprising the steps of:

placing an antenna in close proximity of the lower end of the stand of pipe; said stand of pipe having a shoulder at the lower end thereof; indexing the antenna with the shoulder located at the lower end of the pipe;

connecting a transmitter to the antenna, generating a signal with the transmitter and directing the signal from the antenna along a path substantially parallel to the stand of pipe and towards the traveling block assembly;

mounting a deflector to the traveling block assembly and deflecting the signal back to the antenna to thereby provide a first measurement;

connecting another transmitter to another antenna and directing a second signal from said another antenna along a path which extends across the upper end of the stand of pipe;

receiving the second signal at a location which provides a second measurement indicative of the distance from the upper end of the pipe stand to the deflector;

and combining said first and second measurements in a manner to obtain the length of the stand of pipe 7. The method of claim 6 and further including the step of connecting said another transmitter to a plurality of vertically spaced antennas;

placing another deflector on said traveling block assembly in spaced relationship to said another antenna with the upper end of the stand of pipe being located between said plurality of antennas and said another deflector;

determining the uppermost of said plurality of antennas which is nearest adjacent to the upper terminal end of the stand of pipe; and, measuring the distance from the nearest adjacent of the plurality of vertically spaced antennas to the first deflector;

thereby enabling the length of the stand of pipe to be measured.

8. The method of claim 7 and further including the step of; automatically computing the cumulative total length of a plurality of stands of pipe as the stands of pipe are sequentially measured, and displaying the computed data on a digital read-out, and recording the computed data.

9. The method of claim 6 and further including the step of:

mounting a pivoted arm to structure associated with a drilling rig; said arm having a free end and a pivoted end; mounting the first recited antenna on the free end of said pivoted arm; indexing the free end of the arm with the antenna; and, aligning the free end with the lower shoulder of the stand of pipe.

10. The method of claim 6 and further including the step of incorporating the first recited transmitter and receiver means and the antenna therefor, into a hand held instrument;

providing an edge on the instrument which can be brought into aligned relationship with respect to the lower shoulder of the stand of pipe to thereby index the antenna with respect to the lower shoulder.

11. The method of claim 6 and further including the step of transmitting the second signal from a location adjacent to the first antenna, and deflecting the second signal perpendicularly across the upper end of the stand of pipe, and then back to the location adjacent to the first antenna, thereby providing the recited second measurement.

12. The method of claim 11, and further including the step of mounting the first recited antenna on the free end of a pivoted arm; indexing an edge located at the free end of the arm with the first recited antenna; and, aligning the edge with the lower shoulder of the stand of pipe;

automatically computing the cumulative total length of a plurality of sequentially measured stands of pipe and displaying and recording the computed data.

13. Method of tallying the length of tubular members held suspended above the derrick floor of a drilling rig by the traveling block assembly thereof comprising the steps of:

indexing a transmitting antenna respective to the lower end of the tubular members to be measured;

transmitting a signal from said antenna along a line which is substantially parallel to the axial centerline of the tubular members to be measured;

reflecting said signal at a location which is indexed respective to said traveling block assembly to which the upper end of the tubular members are supportedly connected;

receiving the reflected signal with a distance measuring apparatus to provide a first measurement related to the total length of the tubular members to be measured;

transmitting a second signal substantially perpendicular to the upper end of the tubular members to be measured;

receiving the second signal at a location which is indexed respective to the location where said first signal was intercepted;

combining the two signals and thereby ascertaining the length of the tubular goods.

14. The method of claim 13 wherein said traveling block assembly includes an elevator and further including the step of directing the signal from the first recited transmitting antenna to a reflector located on the elevator, and returning the signal from the reflector to the distance measuring apparatus.

15. The method of claim 13 wherein the first signal is intercepted by the provision of a reflector located on a drilling hook associated with the traveling block assembly, and reflecting the signal back to the location of the transmitting antenna which is also the distance measuring antenna.

16. The method of claim 13 wherein a reflector is mounted to the traveling block in order to carry out the step of reflecting the signal back to the antenna located at the lower end of the tubular members, where the distance measuring receiver computes the distance between the lowermost shoulder of the tubular members and the reflector.

17. In a drilling rig having a derrick which extends above a rig floor, with there being an elevator connected to a traveling block by a drilling hook, the combination with said drilling rig of an apparatus for tallying the length of a tubular member which may be suspended above the derrick floor by the elevator;

said apparatus for tallying includes a transmitter for generating a signal, means locating said transmitter in indexed relationship respective to the lower end of the tubular member to be measured;

reflector means mounted in supported relationship respective to said traveling block for reflecting said signal; a receiver means for receiving the reflected signal; means for computing the distance from the point of reflection to the point of transmission;

means adjacent to the upper end of the tubular member to be measured for generating a second signal related to the distance from said reflector to the upper end of the tubular member;

calculator means connected to receive the first and second signals and for integrating the signals to thereby provide the measured lengths of said tubular member.

18. The combination of claim 17 wherein said means for generating a second signal includes a second transmitter oriented to transmit said second signal horizontally across the derrick at an elevation which causes part of the signal from said signal transmitting means to be intercepted by the upper end of said tubular member;

a plurality of signal receiving means arranged vertically respective to one another, so that the upper end of the tubular member can be interposed between the signal receiving means and the transmitter means;

means associated with said plurality of signal receiving means for detecting those signals not intercepted by the tubular member, so that the elevation of the upper end of the tubular member respective to the reflector means can be determined by said calculator means.

19. The combination of claim 17 wherein said second signal is generated by a transmitter which is located in fixed relationship respective to said derrick structure, and said reflector means is mounted in fixed relationship respective to said drilling hook.

20. The combination of claim 17 wherein said apparatus for tallying includes an arm having a pivoted end and a free end, said first and second signals are generated by means mounted to the free marginal end of the pivoted arm;

said pivoted arm includes means by which it is adjustably mounted respective to the drilling floor so that the arm can be pivoted in a horizontal plane to move the apparatus away from the tubular goods, and means by which the arm can be moved horizontally and brought into alignment with the lower end of the tubular members to be measured.

21. The combination of claim 17 wherein said transmitter means and receiver means are housed within an enclosure means; said antenna means is mounted on said enclosure means; means on said housing by which the antenna can be indexed respective to the lower end of the tubular member;

said reflector means is mounted in indexed relationship respective to the upper end of the tubular goods; so that the distance between the lower end and upper end of the tubular member can be calculated.

22. Method of tallying the length of a tubular member held suspended above the derrick floor of a drilling rig by the traveling block assembly comprising the steps of:

indexing a transmitting antenna respective to the lower end of the tubular member to be measured;

transmitting a signal from said antenna along a line which is substantially parallel to the axial centerline of the tubular member to be measured, said line being located externally to said tubular member;

intercepting said signal at a location which is indexed respective to the upper end of the tubular member which is suspended within the traveling block assembly;

receiving the intercepted signal with a distance measuring apparatus and comparing the transmitted and received signals to provide a measurement related to the total length of the tubular member being measured.

23. The method of claim 22 wherein the interception of said signal occurs at a location on said traveling block assembly and includes the step of adjustably mounting a reflector means on structure supported by said traveling block assembly, and moving said antenna in a vertical plane in order to achieve the step of indexing the location thereof respective to the upper end of the pipe.

* * * * *